US006398480B1

(12) United States Patent
Baginski et al.

(10) Patent No.: US 6,398,480 B1
(45) Date of Patent: Jun. 4, 2002

(54) FORK LIFT TRUCK

(75) Inventors: Ralf Baginski, Neetze; Ernst Peter Magens, Ammersbek; Michael Niebuhr, Bargteheide; Paul Rickers, Norderstedt; Ing. Torsten Hunte, Hamburg, all of (DE)

(73) Assignee: Jungheinrick Aktiengesellschaft, Hamburg (DE)

( * ) Notice: Subject to any disclaimer, the term of this patent is extended or adjusted under 35 U.S.C. 154(b) by 0 days.

(21) Appl. No.: 09/698,866

(22) Filed: Oct. 27, 2000

(30) Foreign Application Priority Data

Oct. 30, 1999 (DE) ..... 199 52 532
Feb. 3, 2000 (DE) ..... 100 04 622

(51) Int. Cl.[7] ..... B66F 9/06

(52) U.S. Cl. ..... 414/631; 414/635; 414/641; 414/673; 187/222; 180/209

(58) Field of Search ..... 414/631, 634, 414/635, 636, 639, 641, 673; 180/209; 187/222

(56) References Cited

U.S. PATENT DOCUMENTS

| | | | | | |
|---|---|---|---|---|---|
| 3,616,953 | A | * | 11/1971 | Shaffer et al. | 414/631 |
| 4,511,974 | A | * | 4/1985 | Nakane et al. | 364/463 |
| 4,571,139 | A | * | 2/1986 | Moseley et al. | 414/347 |
| 4,763,800 | A | * | 8/1988 | Engler et al. | 212/195 |
| 5,482,141 | A | * | 1/1996 | Wilson | 187/225 |
| 5,879,124 | A | * | 3/1999 | Brouwer et al. | 414/631 |
| 6,079,935 | A | * | 6/2000 | Brunner et al. | 414/641 |

FOREIGN PATENT DOCUMENTS

DE 1 047 719 12/1958

* cited by examiner

*Primary Examiner*—Steven A. Bratlie
(74) *Attorney, Agent, or Firm*—Vidas, Arrett & Steinkraus, P.A.

(57) ABSTRACT

The invention relates to a fork-lift truck including a vehicle body which has rear wheels and a lift frame for load-carrying means, and including a wheel bearing means. For an increase in stability in standing of the fork-lift truck, a shifting or pivoting device interacting with the vehicle body is provided, which moves the wheel bearing means with respect to the vehicle body while varying the axle base and the distance of the load center from the front wheel.

20 Claims, 5 Drawing Sheets

FORK LIFT TRUCK

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to a fork-lift truck.

Fork-lift trucks prove to be universal-use equipment to pick up pallets from the floor and to handle and stack them. They may be provided with a combustion motor or an electric motor. The fork-lift truck picks up the load and carries it to the desired place of destination. The front wheels are supported on a wheel bearing means wherein this one, e.g. in fork-lift reach trucks, may also have wheel arms extending in the vehicle longitudinal direction between which the load can be lowered. Since the load is picked up outside the basis of standing a load moment will arise which might cause the fork-lift truck to tilt about the front axle. The load moment has to be compensated for by a corresponding righting moment. The purpose is served by the dead weight of the vehicle that can be increased by separate counterweights at the other end of the vehicle (counterweight-type fork-lift truck). Thus, a defined working load of the fork-lift truck is opposed by a relatively large dead weight which requires to be accelerated and decelerated again during each driving and braking action. Also, the dead weight will increase the resistance to vehicular motion as well as the loads imposed on the wheels and presupposes a sufficient load-carrying capacity of the floor. Therefore, if lifting heights are larger the ultimate load admissible requires to be reduced as otherwise the stability of the vehicle will be jeopardized, especially when the load is lifted.

Different attempts were made in the past to increase the stability in standing of a fork-lift truck. A mobile fork-lift truck having a rearwardly inclinable lift mast is known from the patent specification DE 1 047 719 open to public inspection. The document discusses several designs of fork-lift trucks. For improved stability, it describes that if a lift mast inclines backwards an automatic approach of the inclinable hinge of the lift mast and the front wheel to each other is effected simultaneously. The mentioned document also describes a lift mast hinged to the vehicle which may be swiveled by a hydraulic cylinder, this one being hinged to the lift mast and the vehicle. If the lift mast is inclined backwards the front wheels undergo forward swiveling at the same time. The known devices have numerous drawbacks when in practical use. When stacking goods the lift frame should stand as vertical as possible and, hence, the frame requires to be pivoted first from the inclined position to an upright one before a pallet can be picked up or delivered at larger heights. For the rest, it will be left to the driver, in the known case, to move to appropriate inclinations of the lift frame.

It is the object of the invention to provide a mobile fork-lift truck which, while having a dead weight as low as possible and being of a simple structure, may selectively be given a larger stability in standing, especially if lifting heights are large.

BRIEF SUMMARY OF THE INVENTION

According to the invention, the object is attained by a fork-lift truck of the type described at the beginning the wheel bearing means of which has a shifting device interacting with the vehicle body, which selectively shifts the wheel bearing means with respect to the vehicle body in the vehicle longitudinal direction while varying the distance between the front and rear wheels and the distance between the centre of gravity of a load disposed on the load-carrying means and the front wheel. The fork-lift truck has a vehicle body on which the rear wheels are supported. The front wheels of the fork-lift truck are supported on the wheel bearing means which is connected to the vehicle body via the shifting device. At this point, each front wheel may have a wheel bearing means of its own or a common wheel bearing means for two front wheels may be provided. The shifting device causes the wheel bearing means and the vehicle body to be shifted relative to each other. The shifting action changes the distance between the front wheels and rear wheels of the fork-lift truck. Likewise, the distance between the load centre of a load disposed on the wheel bearing means and the front axle is changed in the opposite sense. Thus, the fork-lift truck has an axle base adjustable by the shifting device. The advantage in using a wheel bearing means with a shifting device is that the distance between the front and rear wheels can be adjusted by it. Since a tilting motion of a fork-lift truck handling a load is performed via the front axle shifting the front wheels away from the rear wheels of the vehicle body will displace the tilting edge to the front and reduce the tipping moment. At the same time, the righting moment of the vehicle body will be increased with the weight being the same.

In a particularly preferred aspect of the inventive fork-lift truck, the rear wheel has a braking device which, while responding to an actuation of the shifting device, blocks the rear wheel for the duration of the shifting operation. If the rear wheel is not blocked the front and rear wills will roll on the surface on which the fork-lift truck stands if the wheel position is varied. Depending on the nature of the surface on which the truck stands and the rolling drag on the wheels, the wheels will roll through a varying portion of the push length. For example, if the fork-lift truck has loaded a heavy load the rear wheel usually runs more easily so that if the wheel bearing means is shifted the vehicle body will be shifted rearwards by a certain portion of the shifting length. Such a rearward travel of the vehicle body is undesirable because the rearward travel makes it more difficult to manoeuvre and to precisely lift the load which was picked up. To avoid shifting backwards the vehicle body while the wheel bearing means is shifted forwards the rear wheel is blocked for the duration of the shifting operation whereas the front wheel is free to rotate.

As an alternative or in addition to the above described braking device, the fork-lift truck may have a front wheel provided with a drive and a control connected to a sensor where the sensor determines the push length traveled by the wheel bearing means with respect to the vehicle body and the control translates the push length determined into a control signal for the drive which causes the front wheel to roll in a sense of rotation and at an angle of rotation which correspond to the push length which has already been traveled. The purposive actuation of the front wheel prevents a counterforce to be applied to the vehicle body which will shift it rearwards. Rather, the front wheel is driven in order to move the wheel bearing means forwards, especially if the fork-lift truck carries a load. The driven front wheel rolling motion is such that the wheels are driven according to the push length. As a result of a controlled drive of the wheels, the position of the vehicle body is not changed by the shifting operation whereas the wheel bearing means moves away from the vehicle body or approaches it.

For a simple structure of the shifting device, it is opportune for the shifting device to have a linear guide element along which the wheel bearing means is designed to be shifted by a displacing element mounted on the vehicle body. Using a guide element permits to simply shift the wheel bearing means. Also, the two-part structure of the shifting device comprising a guide element and a displacing element proves to be easy in manufacture and particularly sturdy.

In a preferred embodiment of the inventive fork-lift truck, the guide element has at least one straight guide rail. Using a guide rail for the shifting device permits to simply incorporate the shifting device in the wheel bearing means and the vehicle body. The fact that two guide rails can be disposed in parallel and above each other in the lower area of the vehicle body makes it unnecessary to modify the rest of the vehicle body structure.

In a particularly advantageous embodiment of the inventive fork-lift truck, either side of the vehicle body has disposed on it a lower guide and an upper guide with the guides extending in parallel with each other. Using a lower guide and an upper guide increases the stability of the fork-lift truck, particularly if it picks up large loads.

In another useful aspect of the invention, the wheel bearing means provides two guide elements on it each of which is disposed laterally in the vicinity of the front wheels. Using two externally disposed guide elements increases the stability in connecting the wheel bearing means to the vehicle body. In particular, the arrangement of the guide elements which is comparatively far outside laterally permits to achieve a high anti-torsion stiffness between the wheel bearing means and the vehicle body. Also, guide elements thus disposed may be easily integrated in the vehicle body with no need to modify the arrangement of the components to a wide extent.

An advantageous embodiment of the inventive fork-lift truck includes hydraulic cylinders acting as displacing elements which are disposed each in parallel with the guide element. Such a parallel arrangement of a hydraulic cylinder saves space and ensures efficient force transmission. Also, it constitutes a simple option to transmit forces between the wheel bearing means and the vehicle body.

In a particularly advantageous aspect of the inventive fork-lift truck, the wheel bearing means is of a H-shaped form with the front wheels being substantially supported at the leg ends and the lift frame being disposed, in part, between the legs. As a result, the lift frame is closer to the front wheel axles, which reduces the tipping moment applied by a picked-up load to the vehicle body.

The lift frame advantageously is pivotally hinged to the vehicle body and has an inclining device which allows to adjust the position of the lift frame. Specifically, it proves opportune for the inclining device to act between the vehicle body and the lift frame.

The inventive fork-lift truck appropriately has a control device for an actuation of the inclining and shifting device, which actuation of the inclining device is effected according to the extent to which the wheel bearing means is shifted. This actuation enables the shiftable wheel bearing means to be flexibly used and, in addition, will increase the stability in standing by inclining the lift frame accordingly. The lift frame advantageously has sensors for the height and/or weight of a picked-up load. Depending on the data acquired which are transmitted to the control device the inclining and shifting device is actuated in dependence on the height and/or weight of the load. This permits to combine various stability-increasing measures depending on the height and/or weight. In particular, provisions can be made for the shift of the wheel bearing means, e.g. in case of a smaller load, to be effected less far than in case of a larger load.

According to the invention, the object is also attained by a fork-lift truck of the type mentioned at the beginning wherein the lift frame is pivotally hinged to the vehicle body and has an inclining device and wherein the wheel bearing means also is pivotally hinged to the vehicle body and has a pivoting device which pivots the wheel bearing means with respect to the vehicle body in the vehicle longitudinal direction while varying the distance between the front wheel and the rear wheel and the distance between the centre of gravity of a load disposed on the load-carrying means and the front wheel wherein a sensor is provided for determining the lifting height of the load-carrying means and is connected to a control device and the control device controls the actuation of the pivoting device in dependence on the lifting height in the sense of an increase in distance if the lifting height increases, wherein the inclining device, regardless of this, maintains the lift frame in a preset position or brings it into a preset position. In this embodiment of an inventive fork-lift truck, the wheel bearing means is pivotally hinged to the vehicle body. The pivoting motion of the wheel bearing means achieves the aforementioned advantages of an increased wheel base and a decreased tipping moment. In a fork-lift truck having a pivotable wheel bearing means, pivoting is effected in dependence on the lifting height of the load-carrying means and, hence, in dependence on the tipping moment. The positioning of the lift frame may be performed here regardless of the position of the pivoting device.

To prevent the vehicle body from moving backwards while the wheel bearing means is being pivoted the rear wheel may have a breaking device which, while responding to an actuation of the pivoting device, blocks the rear wheel for the duration of the pivoting operation. Like the shifting operation, the pivoting operation causes a backward motion of the vehicle body, which is undesirable. To prevent the vehicle body from supporting itself on the front wheels which rotate worse a provision is made that the rear wheels are blocked whilst the front wheels are free to rotate.

In a particularly preferred aspect of the inventive fork-lift truck, the front wheel, alternatively to or apart from having the above mentioned braking device, may have a drive and a control including a sensor wherein the sensor determines the pivoting distance traveled by the wheel bearing means with respect to the vehicle body and the control translates the pivoting distance determined into a control signal for the drive which causes the front wheel to roll in a sense of rotation and at an angle of rotation which correspond to the pivoting distance. Using the drive of the front wheel, the wheel bearing means travels in synchronism with the pivoting motion so that no counterforce is applied to the vehicle body.

In an appropriate aspect of the fork-lift truck, the inclining device acts between the wheel bearing means and the lift frame. In case of this hinge type of the inclining device, the lift frame swivels about the frame-mounted pivot with the point of engagement of the inclining device on the wheel bearing means moving relative to the vehicle body as the wheel bearing means is pivoted. The inclining device may be disposed such that an inclination of the lift frame may be performed both towards the vehicle body and away from it.

In order to maintain a lift frame position which is not dependent on the pivoting motion of the wheel bearing means the inclining device may actuate the lift frame in an opposed sense if the wheel bearing means is pivoted.

As an alternative to the last mentioned aspect, it may be useful that the inclining device acts between the vehicle body and the lift frame. With this attachment, the inclination of the lift frame is solely determined by the inclination device regardless of the position of the wheel bearing means. Expediently, a hydraulic cylinder is provided as a second displacing element.

In a preferred aspect of the inventive fork-lift truck, the wheel bearing means and the lift frame have a common pivoting axis. Such a common pivoting axis can be realized in a particular simple way by a hinge point which is common to the lift frame and the wheel bearing means. What further is advantageous in a common pivoting axis is that if a predetermined position is traveled to the swiveling motion is of a simple geometry.

In an appropriate aspect, the vehicle body mounts two parallel, forwardly projecting holder arms each of which pivotally supports a bearing arm for a front wheel. In this further aspect, the rear side of the lift frame includes bearing portions which are supported on the same axis as the bearing arms with the bearing arms being connected via a joining portion on which a displacing cylinder is hinged for the inclining device.

BRIEF DESCRIPTION OF THE SEVERAL VIEWS OF THE DRAWINGS

Two advantageous embodiments of the inventive fork-lift truck will now described in greater detail with reference to the Figures below.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
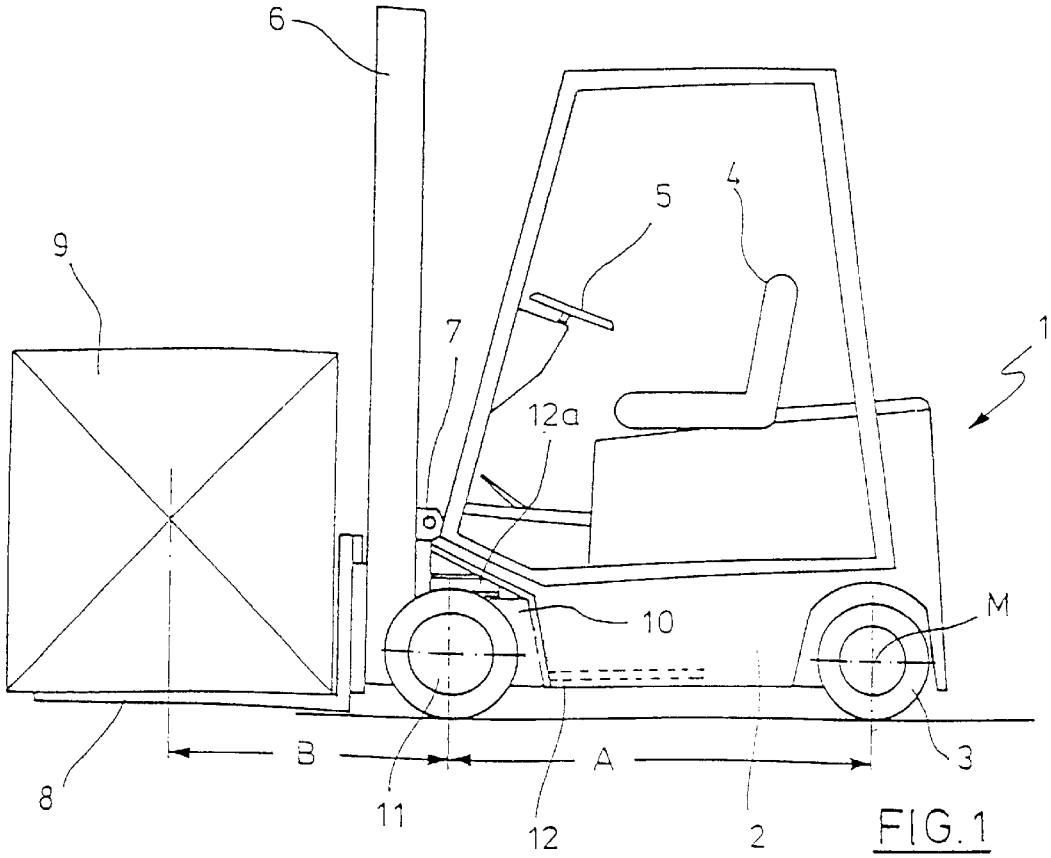
FIG. 1 shows a side view of an inventive fork-lift truck including a vertical lift frame with a load lowered.

FIG. 1 shows a side view of a fork-lift truck 1 with a vehicle body 2. The vehicle body 2 possesses two front wheels 11 which are driven by a motor (not shown) and two steerable rear wheels 3. Likewise, a seat 4 and a steering mechanism 5 are provided for the driver.

Hinged to the front of the wheel body 2 at 7 is a lift frame 6. In the embodiment shown, the lift frame 6 has a load carrier 8 which carries a load 9 which is schematically shown for illustration.

Connected to the vehicle body 2A is a wheel bearing means 10. The integral wheel bearing means 10 which is shown has supported thereon front wheels 11. Hinged to the wheel bearing means 10 are two displacing cylinders 13 which shift the wheel bearing means 10 with respect to the vehicle body 2. The wheel bearing means 10 is guided by two straight rails 12, 12*a* disposed in parallel with each other in appropriate guide seats on either side of the vehicle.

The features which are decisive of fork-lift truck stability substantially are the distance between the rear wheels 3 and the front wheels 11 (axle base) and the distance between the front-wheel axle and the load centre; such distances are indicated by A and B in FIG. 1 where B represents the distance between the perpendicular dropped in the load centre and the front-wheel axle. If the front wheels 11 are shifted with respect to the rear wheels 3 the distance between the front and rear wheels will increase with respect to A', cf. FIG. 3. At the same time, the distance B between the load centre and the front wheel will decrease to an equal degree. The distances with the wheel bearing means shifted forwards are indicated by A' and B' in FIG. 3. Since the lift frame 6 is hinged to the vehicle body the overall length of the fork-lift truck remains the same before and after the wheel bearing means is shifted (A+B=A'+B'). Shifting the front wheels 11 causes the distance B to become smaller and, hence, the tipping moment to diminish. At the same time, the effective torque of the vehicle body 2 (the righting moment) will be increased by the increase in the axle base towards A'. The two effects improve the stability in standing of the inventive fork-lift truck.

To shift the front wheels 11 with respect to the rear wheels 3, a force acts between the wheel bearing means 10 and the vehicle body 2. This force produces a counterforce which translates a fraction of the push length (A'−A) into a rearward motion of the vehicle body unless more measures are taken. To prevent a rearward motion of the vehicle body the rear wheels 3 may be blocked by a brake (not shown) during the push-forward motion. With the rear wheels blocked, the position of the rear wheels and the vehicle body remains unchanged during the shifting operation (cf. the marking M on the rear wheel in FIGS. 1 and 3).

A rearward motion of the vehicle body may be prevented as well if the front wheels are driven according to the shift-forward rate of the wheel bearing means 10.

Figure 2:
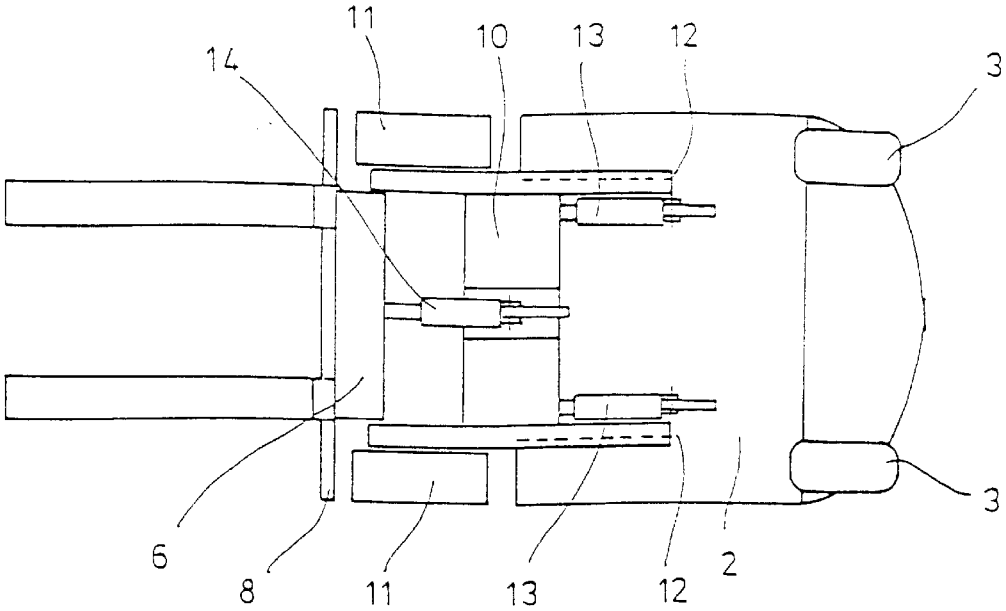
FIG. 2 shows a view of a section through the base frame of the fork-lift truck of FIG. 1.

What also becomes evident from the preceding geometry consideration is that a centre of gravity need not be lifted or lowered because of the shift of the wheel bearing means. Thus, the construction is not additionally charged by the forward shift of the front structure. As can be seen from FIG. 2 the wheel bearing means 10 in this embodiment is substantially of a H-shaped form at the one end of which the front wheels 11 are laterally mounted. At the other end of the wheel bearing means, rails are provided which extend into the vehicle body 2. The wheel bearing means 10 is shifted by the hydraulic cylinders 13 which are disposed in parallel with the guide rails. As can be seen from FIG. 1 the shifting device may be provided far down in the vehicle body. For a protection of the guide elements and hydraulic cylinders, the bottom of the vehicle body may be covered.

Figure 3:
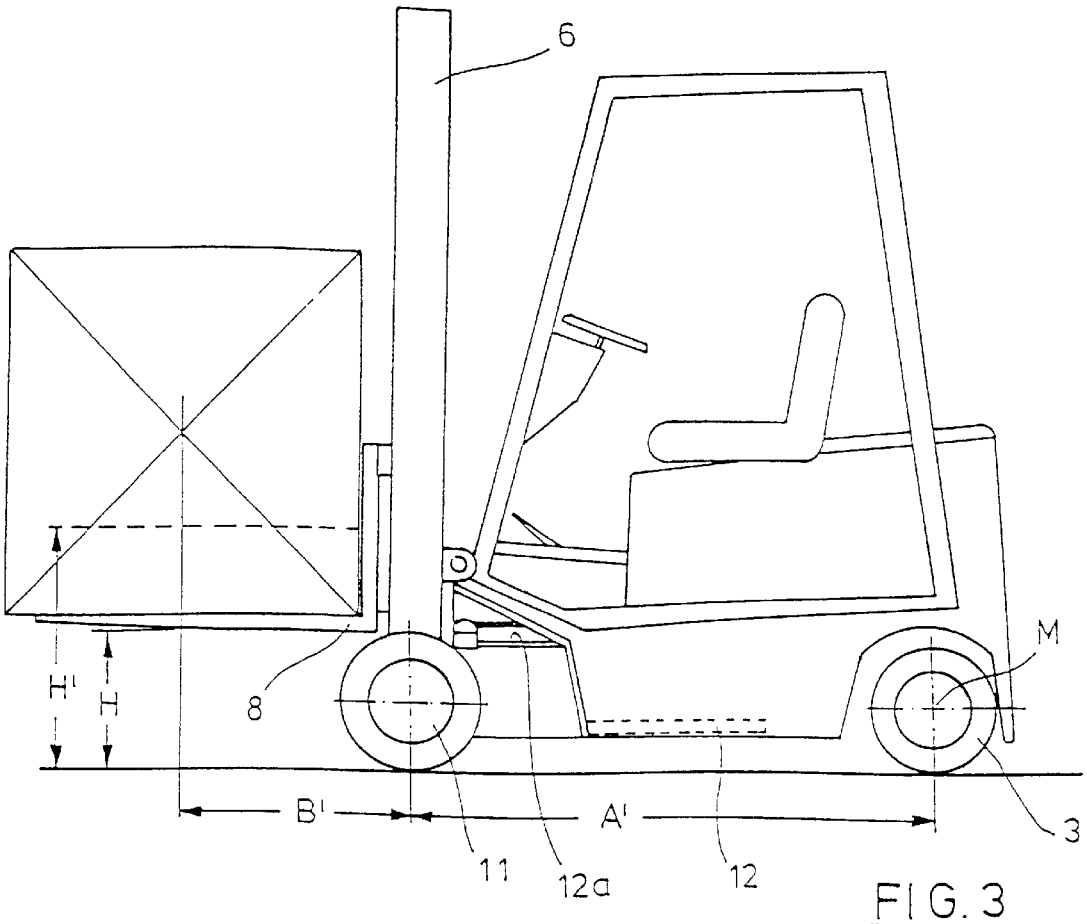
FIG. 3 shows a side view of the fork-lift truck of FIG. 1 with a load lifted.

As can be seen from FIG. 3 that if a load-carrying means 8 is used which extends across the whole width of the fork-lift truck the wheel bearing means cannot be shifted until the load-carrying means has been lifted up to a level H. Therefore, it has proved advantageous to start shifting as soon as the load has reached the level H and to carry out shifting at a speed such that the operation will be completed when the load-carrying means 8 has reached the level H' as well. This is also useful because the dynamic tipping moment augments with height.

Figure 4:
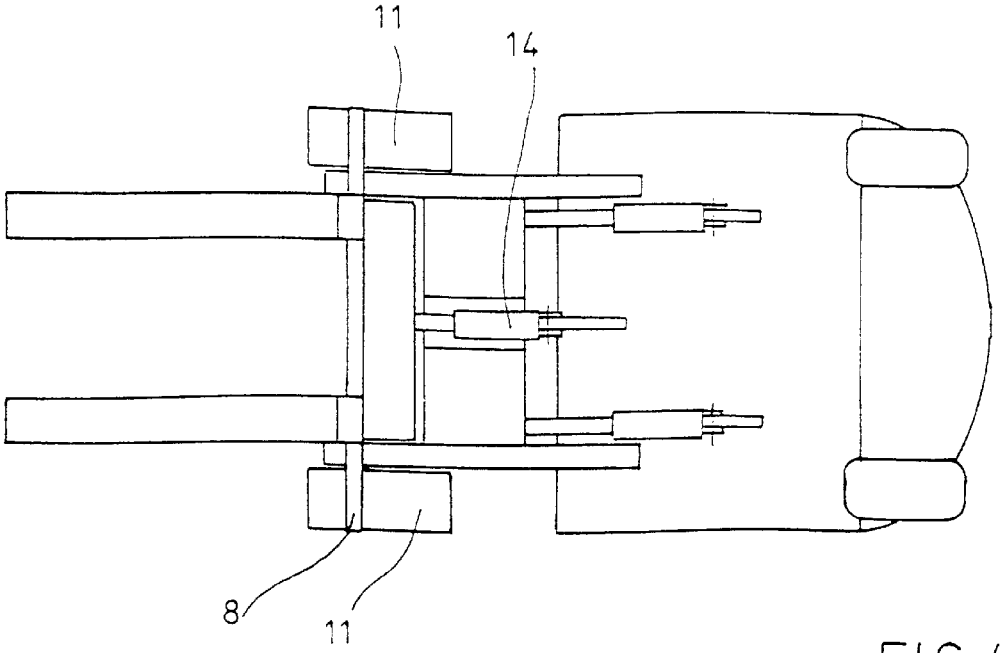
FIG. 4 shows a view of a section through the base frame of the fork-lift truck of FIG. 1 with the wheel bearing means shifted.

FIG. 4 makes it obvious that the end of the load-carrying means that faces the vehicle body 2, when in a pushed-forward condition, partly is above the front wheels 11 and, hence, the axle base requires to be decreased for the moment before a complete lowering of the load-carrying means is effected.

Figure 5:
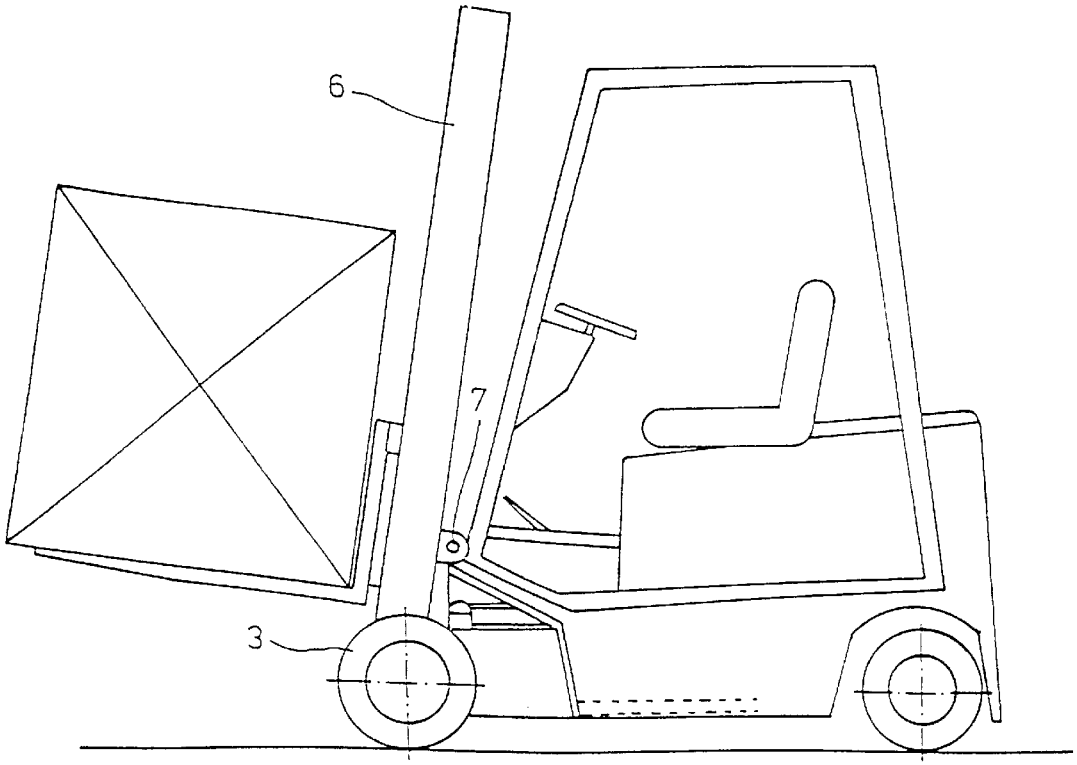
FIG. 5 shows a side view of the inventive fork-lift truck of FIG. 1 with the lift frame inclined and a load lifted.
Figure 6:
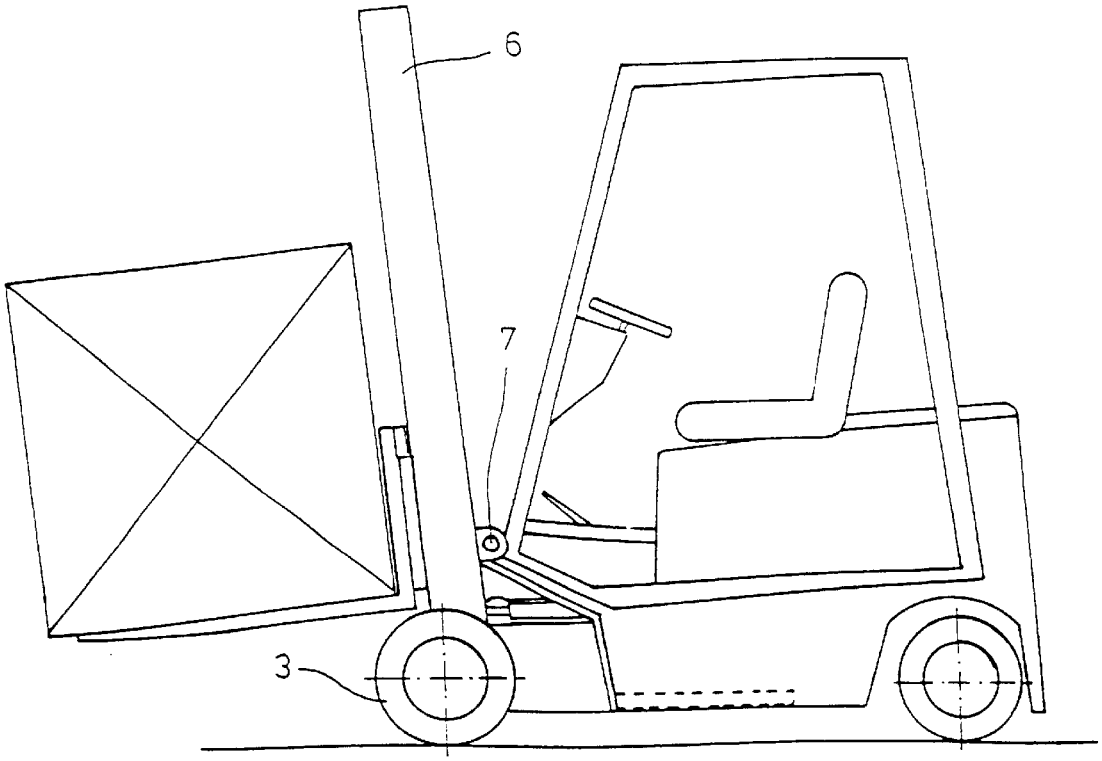
FIG. 6 shows an inventive fork-lift truck of FIG. 1 with the lift frame inclined forwards and a load lifted.
Figure 7:
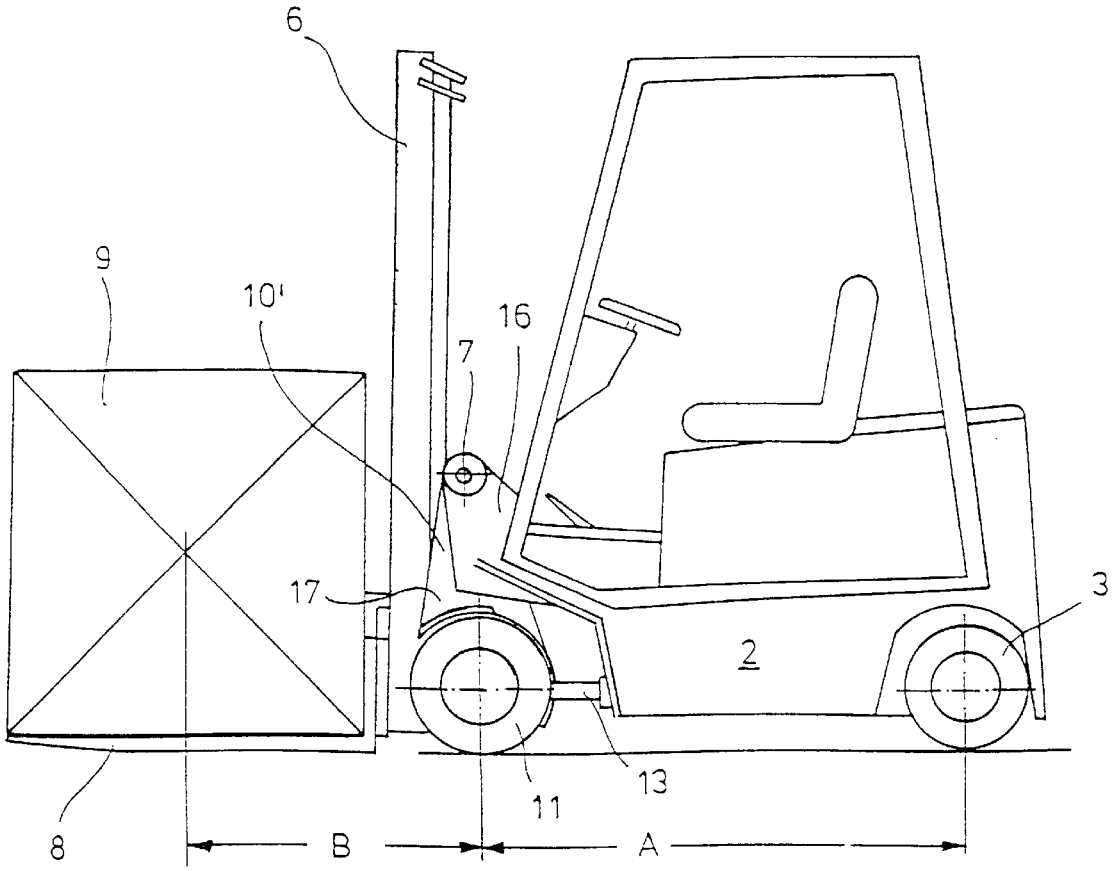
FIG. 7 shows a side view of a second inventive fork-lift truck including a pivotable wheel bearing means.

The lift frame is designed to be pivoted about the pivot 7 by means of an inclining cylinder 14. FIGS. 5 and 6 show the lift frame 6 inclined forwards and backwards, .respectively. The inclination of the lift frame may also serve for picking up or putting down a load more easily. A backward inclination of the lift frame will increase the safety in steering the vehicle, especially in handling loads, by securing the load against slipping. The inclining cylinder 14 is hinged to the vehicle body 2.

FIGS. 7 to 10 show a second advantageous embodiment of the inventive fork-lift truck which includes a pivotable wheel bearing means 10'. Components of this fork-lift truck which are identical to components of the first embodiment are indicated by identical reference numbers.

The vehicle body 2 mounts two lateral holder arms 16 above the front wheels 11. The holder arms 16 substantially extend in the forward direction and their ends have disposed thereon a bearing eyelet each in which a bearing arm 17 of the wheel bearing means 10' is supported. The bearing eyelet also supports a rear-side bearing portion of the lift frame 6. Jointly supporting the lift frame 6 and the wheel bearing means 10' on the holder arm 16 is unnecessary, but has the advantage that pivoting is effected about the same axis.

The bearing arms 17 are interconnected by a joining portion 18 disposed below the hinge which substantially extends between the front wheels 11 supported on the bearing arms 17. Hinged approximately centrally on the joining portion 18 is an inclining cylinder 15 the second hinge point of which is on the lift frame 6. A displacing cylinder 13 is hinged to the joining portion 18 on either side of the inclining cylinder 15 between the inclining cylinder 15 and the bearing arms 17. The second hinge point of the displacing cylinders 13 is always on the vehicle body 2. The two displacing cylinders 13 enable the wheel bearing means to be pivoted with respect to the vehicle body 2. This also changes the position of the lift frame 6. Any position of the lift frame 6 independent on the position of the joining portion 18 requires a countercontrol of the inclining cylinder 15.

Figure 8:
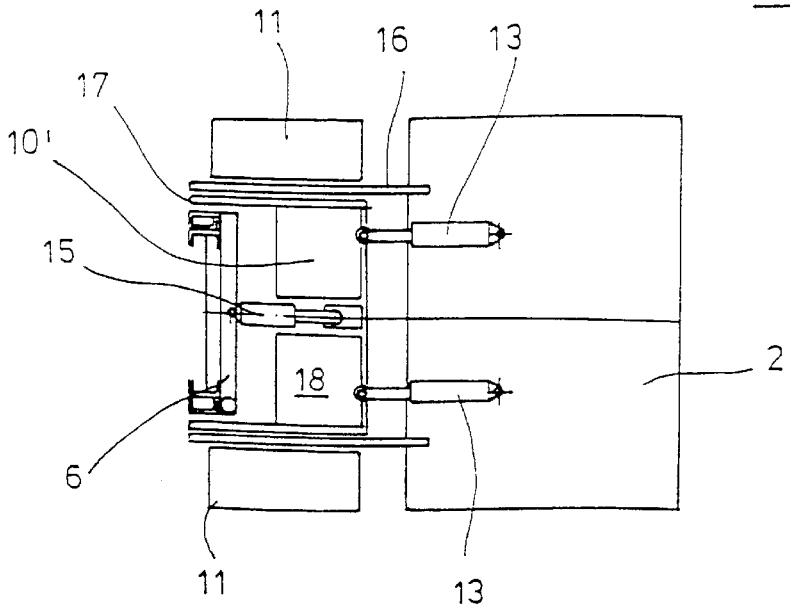
FIG. 8 shows a view of a section through the base frame of the fork-lift truck of FIG. 7.
Figure 10:
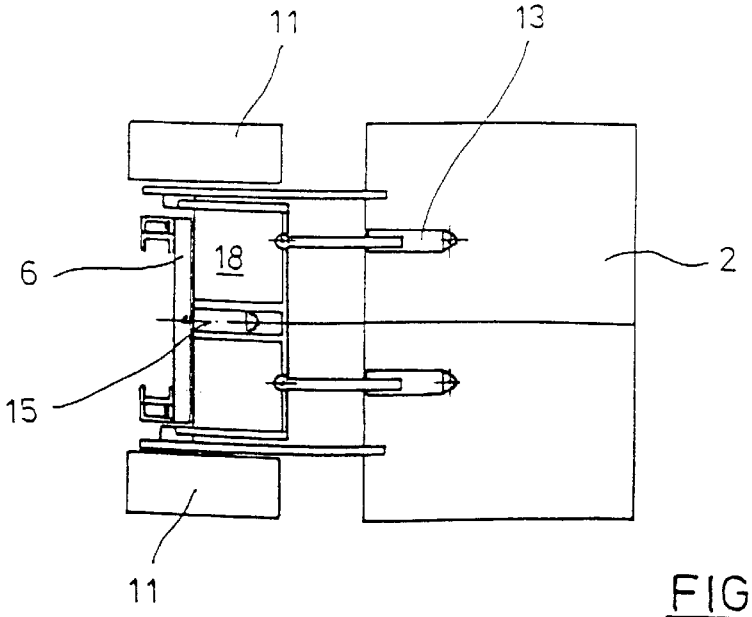
FIG. 10 shows a view of a section through the base frame of the fork-lift truck of FIG. 7 with the wheel bearing means shifted forwards.

The countercontrol becomes evident, according to its principle, from the comparison of FIGS. 8 and 10. FIGS. 8 and 10 show a vertical lift frame 6 in different positions of the wheel bearing means. In the position of FIG. 10, the displacing cylinder 15 is of a minimum length whereas in the position of FIG. 8 for the wheel bearing means that is less far pivoted forwards the inclining cylinder 15 is of a larger length. In an alternative embodiment of the fork-lift truck, it is also possible to hinge the inclining cylinder 15 to the vehicle body 2 so that if the wheel bearing means is pivoted by the displacing cylinder 13 the position of the lift frame 6 will not be changed and any countercontrol may be unnecessary.

Figure 9:
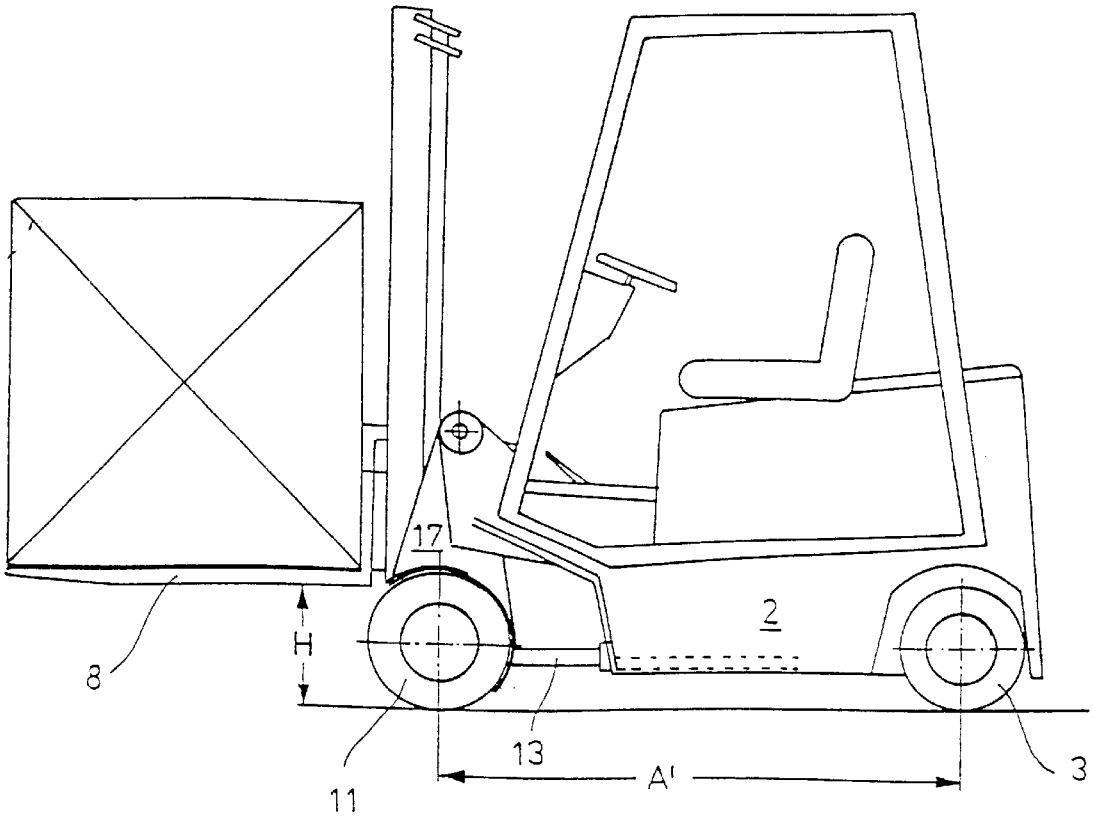
FIG. 9 shows a side view of the fork-lift truck of FIG. 7 with a load lifted.

FIG. 9 shows the fork-lift truck 7 with its front wheels 11 pivoted forwards and its load-carrying means 8 lifted. Here, the front wheels have been pivoted forwards so far that they partly are below the load-carrying means already. When the dimensions of the pivoting range and the load-carrying means are such the inclining cylinder 15 and the displacing cylinder 13 undergo an actuation to the effect that the front wheels are pivoted forwards in dependence on the lifting heights and to the effect that this is performed as far as is possible without the load-carrying means striking against the front wheels as has been described already with regard to the shifting device. Also with reference to FIG. 9, the rotation of the front wheel 11 may be seen with the rear wheel 3 blocked (cf. the cross markings on the wheels). To prevent the vehicle body 2 from rolling back the front wheels 11 in the embodiment shown are rotated by a drive (not shown) during the pivoting motion such as to take the position shown in FIG. 9 with the rear wheels not being displaced.

In the above description of the displacing and inclining cylinders, the control device (not shown) provides that the pivoting operation be controlled in dependence on the lifting height without the driver's intervention. The pivoting of the wheel bearing means may be performed continuously or at predetermined spaced increments. Likewise, it is possible to provide a sensor which detects the weight of the load and takes it into account in pivoting the wheel bearing means in dependence on the lifting height.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A counterbalanced lift truck (1) including a vehicle body (2) which has at least one rear wheel (3) and a lift fame for a load-carrying means (8) mounted to the vehicle body and including at least one wheel bearing means (10) which mounts two front wheels (11) disposed in the vicinity of the lift frame, the front wheels define, independent of a picked-up load on the load-carrying means a front supporting point for the counterbalanced lift truck, wherein the wheel bearing means (10) has a shifting device **(12, 12*a*) interacting with the vehicle body (2), which selectively shifts the wheel bearing means with respect to the vehicle body in the vehicle longitudinal direction while varying the distance between the front wheels and the rear wheel and the distance between a centre of gravity of the load (9)** disposed on the load-carrying means and the front wheel, and wherein control means are provided for actuating the shifting device during operation of the lift truck.

2. The counterbalanced lift truck according to claim 1, characterized in that the rear wheel (3) has a braking device which, while responding to an actuation of the shifting device, blocks the rear wheel for the duration of the shifting operation.

3. The counterbalanced lift truck according to claim 1, characterized in that a sensor is provided which determines the push length traveled by the wheel bearing means (10) with respect to the vehicle body (2), and that the front wheel (11) has a drive with a control which is connected to the sensor and translates the push length determined into a control signal for the drive which causes the front wheel to roll in a sense of rotation and at an angle of rotation which correspond to the push length.

4. The counterbalanced lift truck according to claim 1, characterized in that the shifting device has at least one linear guide element (12, 12*a*) along which the wheel bearing means is designed to be shifted by a displacing element mounted on the vehicle body.

5. The counterbalanced lift truck according to claim 4, characterized in that the guide element has at least one straight guide rail.

6. The counterbalanced lift truck according to claim 4, characterized in that either side of the vehicle body (2) has disposed on it a lower guide and an upper guide with the guides extending in parallel with each other.

7. The counterbalanced lift truck according to claim 6, characterized in that the wheel bearing means provides two guide elements each of which is laterally disposed in the vicinity of the front wheels.

8. The counterbalanced lift truck according to claim 4, characterized in that hydraulic cylinders (13) are disposed as displacing elements each in parallel with the guide element.

9. The counterbalanced lift truck according to claim 1, characterized in that the wheel bearing means is of a H-shaped form with the front wheels being substantially supported at the leg ends and the lift frame being disposed, in part, between the legs.

10. The counterbalanced lift truck according to claim 1, characterized in that the lift frame is pivotally hinged to the vehicle body and has an inclining device.

11. The counterbalanced lift truck according to claim 10, characterized in that the inclining device acts between the vehicle body (2) and the lift frame (6).

12. The counterbalanced lift truck according to claim 10, characterized in that the lift frame has sensors for the height and/or weight of a picked-up load wherein the sensors transmit the data acquired by them to the control device for an appropriate actuation of the inclining and shifting device in dependence on the height and/or weight of the load.

13. A counterbalanced lift track (1) including a vehicle body (2) which has at least one rear wheel (3) and a lift frame (6) for load-carrying means (8), and including at least one wheel bearing means (10') which mounts two front wheels (11), characterized in that the lift frame (6) is pivotally hinged (7) to the vehicle body (2) and has an inclining device (15) and the wheel bearing means (10') also is pivotally hinged (7) to the vehicle body (2) and has a pivoting device (13) which pivots the wheel bearing means with respect to the vehicle body in the vehicle longitudinal direction while varying the distance between the front wheels and the rear wheel (11, 3) and the distance between the centre of gravity of a load (9) disposed on the load-carrying means (8) and the front wheels (11), wherein a sensor is provided for determining the lifting height of the load-carrying means (8) and is connected to a control device and the control device controls the actuation of the pivoting device (13) in dependence on the lifting height (H) in the sense of an increase in distance if the lifting heights increase, wherein the inclining device (15), regardless of this, maintains the lift frame (6) in a preset position or brings it into a preset position.

14. The counterbalanced lift truck according to claim 13, characterized in that the rear wheel (3) has a braking device which, while responding to an actuation of the pivoting device, blocks the rear wheel for the duration of the pivoting operation.

15. The counterbalanced lift truck according to claim 13, characterized in that a sensor is provided which determines the pivoting distance traveled by the wheel bearing means (10') with respect to the vehicle body (2), and that the front wheel has a drive with a control which is connected to the sensor and translates the pivoting distance imposed into a control signal for the drive which causes the front wheel to roll in a sense of rotation and at an angle of rotation which correspond to the pivoting distance.

16. The counterbalanced lift truck according to claim 13, characterized in that the inclining device (15) acts between the wheel bearing means (10') and the lift frame (6).

17. The counterbalanced lift truck according to claim 16, characterized in that the inclining device (15) countercontrols the lift frame (6), while the wheel bearing means (10') is being pivoted, in such a way that the lift frame maintains a position independent on the motion of the wheel bearing means.

18. The counterbalanced lift truck according to claim 13, characterized in that the inclining device (15) acts between the vehicle body (2) and the lift frame (6).

19. The counterbalanced lift truck according to claim 13, characterized in that the wheel bearing means (10') and the lift frame (6) have a common pivoting axis (7).

20. The counterbalanced lift truck according to claim 19, characterized in that the vehicle body (2) mounts two parallel, forwardly projecting holder arms (16) each of which pivotally supports a bearing arm (17) for a front wheel (11), the lift frame, at its rear side facing the vehicle body (2), has bearing portions which are supported on the same axis as the bearing arms, and the bearing arms (17) are connected via a joining portion (18) to which an inclining cylinder (15) is hinged for the inclining device.

* * * * *

UNITED STATES PATENT AND TRADEMARK OFFICE

CERTIFICATE OF CORRECTION

PATENT NO. : 6,398,480 B1
DATED : June 4, 2002
INVENTOR(S) : Baginski et al.

It is certified that error appears in the above-identified patent and that said Letters Patent is hereby corrected as shown below:

Title page,
Item [73], Assignee, delete "Jungheinrick" and insert -- Jungheinrich --

Signed and Sealed this

Twenty-first Day of January, 2003

JAMES E. ROGAN
*Director of the United States Patent and Trademark Office*